US005935469A

United States Patent [19]

Deo et al.

[11] Patent Number: 5,935,469

[45] Date of Patent: Aug. 10, 1999

[54] INSULATING STAPLE FOR HOLDING THE RESISTIVE MEMBER OF A HEATING ELEMENT IN PLACE

[75] Inventors: Subhash R. Deo, Fayette, Ala.; Simon P. Griffiths, Columbus, Miss.

[73] Assignee: Emerson Electric Co., St. Louis, Mo.

[21] Appl. No.: 08/956,846

[22] Filed: Oct. 23, 1997

[51] Int. Cl.[6] ..... H05B 3/68

[52] U.S. Cl. ..... 219/458; 219/467

[58] Field of Search ..... 219/457, 458, 219/459, 463, 464, 466, 467, 468, 542; 338/280, 281, 284

[56] References Cited

U.S. PATENT DOCUMENTS

| | | | |
|---|---|---|---|
| 3,612,828 | 10/1971 | Siegla | 219/467 |
| 3,833,793 | 9/1974 | McWilliams et al. | 219/467 |
| 4,161,648 | 7/1979 | Gossler | 219/464 |
| 4,296,311 | 10/1981 | Hagglund et al. | 219/467 |
| 4,864,105 | 9/1989 | Morgan et al. | 219/467 |
| 5,369,874 | 12/1994 | McWilliams | 219/467 |
| 5,393,958 | 2/1995 | Gross et al. | 219/467 |
| 5,453,597 | 9/1995 | McWilliams | 219/467 |
| 5,837,975 | 11/1998 | Dillard et al. | 219/467 |

*Primary Examiner*—Teresa Walberg
*Assistant Examiner*—Sam Paik
*Attorney, Agent, or Firm*—Polster, Lieder, Woodruff & Lucchesi

[57] ABSTRACT

A heating unit (H) for a cook top includes a thin and relatively fragile resistive heating element like, but not necessarily limited to, a ribbon (E). The heating element is mounted on the upper surface of a cake (I) of microporous insulation material. The heating element is arranged in a predetermined pattern on the material and a plurality of staples (10) are used to attach and hold the heating element on the material surface. Each staple is a glass staple and the staples are spaced along the length of the heating element to mount the heating element to the insulation. The staples are electrically non-conductive and do not create heat sinks at their locations of use. Thus, they do not affect the efficiency of heat transfer between the heating element and that which is being heated. The staples are also of a glass material which can withstand high temperatures and numerous temperature cycles to provide a long service life.

14 Claims, 1 Drawing Sheet

INSULATING STAPLE FOR HOLDING THE RESISTIVE MEMBER OF A HEATING ELEMENT IN PLACE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to heating units employing resistive conductors to construct heat elements, and more particularly, to an insulating staple used to attach and hold such an element in place on a thermal and electrical insulation material.

In electrical heating units of the type used in cook tops for ranges, one type of heating element employed is a resistive conductor exposed to air. When an electric current is passed through the conductor, the power dissipated raises the conductor's temperature. Radiant energy is generated which performs the heating function of the element. In some applications, a thin, elongate strip of a metallic ribbon heating material is passed through a machine which corrugates the material. Such a construction is shown, for example, in U.S. Pat. No. 5,393,958. Other patents of interest with respect to ribbon heating elements include U.S. Pat. Nos. 5,453,597, 5,369,874 and 4,161,648. When a current is applied to the ribbon heating element, heat generated by the resulting $I^2r$ losses is radiated at a utensil set upon the unit. During a heating cycle, the heating element expands and contracts. If the element is constrained to move, stresses are created in the material; and, stress fractures are the primary cause of heating element failures.

In our work in regard to this development, we decided, instead of pressing an edge of a ribbon into the insulation material, to lay the heating element on top of the insulation material, but not to press it into the material. Then, commercially available metal staples were used to secure the heating element in place. There are, however, a number of problems with this approach. First, the staples create non-uniform heating spots because of the concentrated mass of material at each staple location. In addition, the staples obstruct heat radiation to the utensil being heated because the staples absorb the heat radiated by the ribbon heating element in the area around the staple. The conventional wire staples are also quite rigid and they damage the heating element member when pressed too tightly against the heater conductor. The large cross section of the conventional staple does not allow them to be placed close together; this is necessary to avoid short circuits as well as insertion damage to the insulating cake. This leaves large segments of the heater conductor unconstrained and may lead to the unwanted movement of that conductor during handling and transportation. The bulk of the conventional wire staple has excess thermal mass that drains the heat energy from the conductor to raise its temperature. This affects the overall performance of the unit. The conventional wire staple is never able to absorb enough heat from the conductor to become radiant. This together with its large size has a masking effect on the glowing conductor of the heating unit, resulting into dark areas at different locations over the heater geometry. This is aesthetically undesirable.

BRIEF SUMMARY OF THE INVENTION

Among the several objects of the present invention may be noted the provision of staples for use with an electrical conductor such as a ribbon heating element used with a cooking unit or the like for installing the heating element;

- the provision of such a staple to be a non-metallic material capable of withstanding the heat generated by the heating clement in place;
- the provision of such a staple which effectively mounts the heating element in place without damaging a cake of insulation material on which the element is installed and which allows the heating element to expand and contract during a heating cycle;
- the provision of such a staple to not affect the efficiency of heat transfer between the heating element and whatever is being heated by eliminating hot spots at those locations where a staple is used;
- the provision of such a staple which, when used, does not appear as a dark spot to one viewing the heating element so the heating element, when a current is supplied to it, has a uniform appearance;
- the provision of such a staple to be a transparent, electrically insulating glass material capable of withstanding high temperatures;
- the provision of such a glass staple to be a tinted glass material;
- the provision of such a glass staple to have sufficient mechanical strength to withstand numerous heating cycles of the heating element without cracking or breaking;
- the provision of such a glass staple which is readily installed by an automated manufacturing process so to simplify the cost of assembly of a heating unit; and,
- the provision of such a glass staple which is low cost.

In accordance with the invention, generally stated, a heating unit for a cook top or the like includes a ribbon-type heating element. The heating element is mounted on the upper surface of a cake of microporous insulation material. The heating element is arranged in a predetermined pattern on the material and a plurality of staples are used to attach and hold the heating element on the material surface. Each staple is a glass staple and the staples are spaced along the length of the heating element. The staples are electrically non-conductive and are transparent to the heat radiated from the resistive member so as to not affect the efficiency of heat transfer between the heating element and that which is being heated. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
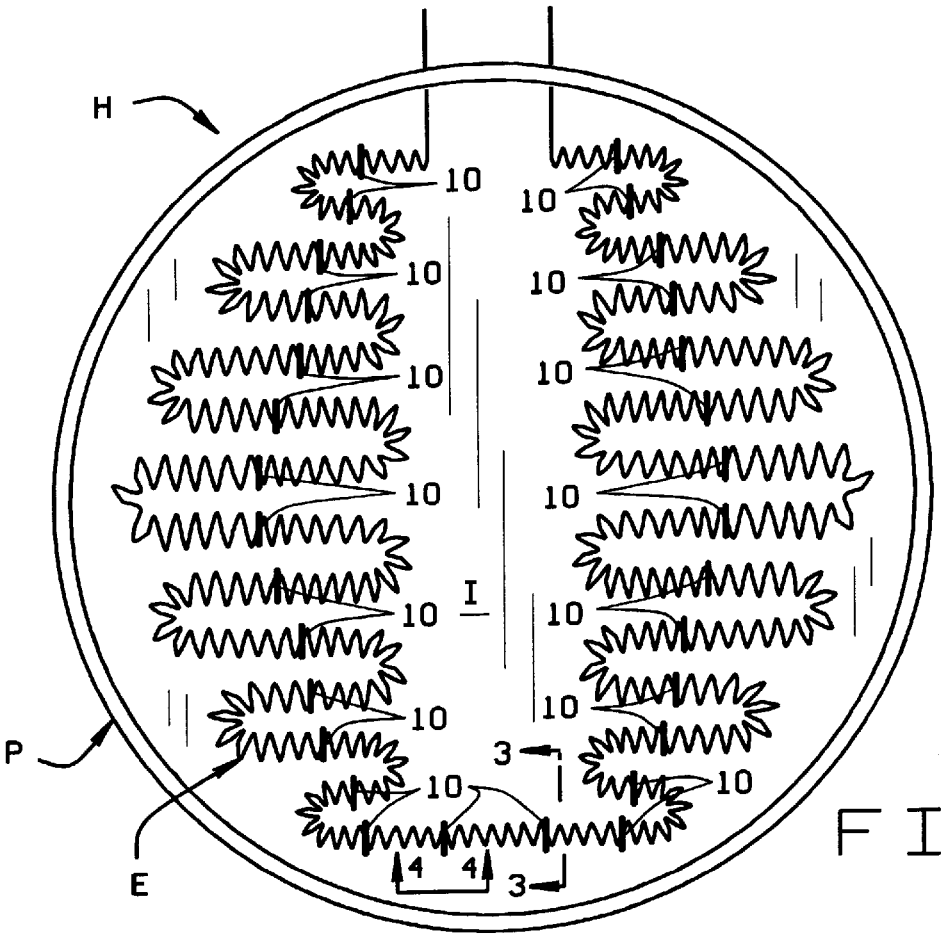
FIG. 1 is a top plan view of a cooking unit including a cake of insulation material and a ribbon heating element which is installed on the insulation material.
Figure 5:
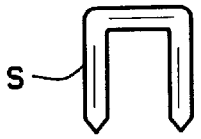
FIG. 5 PRIOR ART
Figure 4:
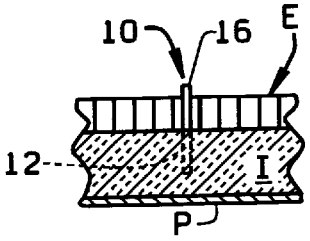
FIG. 4 is a sectional view taken along line 4—4 in FIG. 1 also showing use of the staple; and, FIG. 5 is an elevational view of a prior art staple used to mount the heating element to the insulation.

Referring to the drawings, a heating unit H is used on cook tops for stoves and ranges. The heating unit includes a circular metal pan P which is a generally flat bottomed pan having an upraised side extending about the circumference of the pan. A cake I of a microporous insulation material is sized to fit in the pan. A heating element E having a preferred pattern or shape is installed or mounted on an upper surface of the insulation material. The pattern shown in FIG. 1 is exemplary only. As seen in FIGS. 1 and 4, the heating element is a ribbon heating element; that is, it has a series of corrugations formed along its length. Heretofore, a ribbon heating element was mounted on the insulation by either pressing an edge of the element into the insulation, forming grooves in the insulation and inserting the edge of the heating element into the grooves, or laying the heating element on the surface of the insulation and pressing wire metal staples S such as shown in FIG. 5 into the insulation material to hold the heating element in place. The problems with the use of such staples has been previously described. In general, their use creates a range of problems in the manufacture and use of a heating unit employing a ribbon heater element.

Figure 2:
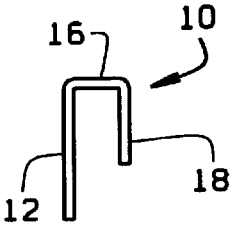
FIG. 2 is side elevational view of a glass staple of the present invention used to mount the heating element on the insulation.

In accordance with the present invention, and as shown in FIG. 2, an insulating glass staple 10 is used in place of the staples S to securely mount a heating element E to the upper surface of a cake I of insulation material. Importantly, staples 10 are non-metallic staples and are preferably made of a transparent, electrically insulating glass material capable of withstanding high temperatures. As such, the staples 10 have a number of advantages over conventional metal staples. A major advantage is that the glass staples 10 have good heat transfer characteristics so that their use does not affect the efficiency of heat transfer between heating element E and that which is being heated by the heating unit. The staples do not form heat sinks at those locations where they are used so hot spots are eliminated. Because the glass can withstand high temperatures, the staples will not deform or break as a result of the temperature cycling experienced by the heating element. Because the glass staples are electrically non-conducting, the potential for shorts caused by a staple bottoming out against pan P. or two staples coming into contact is eliminated.

Figure 3:
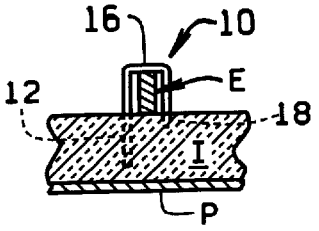
FIG. 3 is a sectional view taken along line 3—3 in FIG. 1 showing use of the staple.

Staples 10 are generally U-shape in form with one leg 12 of the staple being longer than the other leg 14 thereof. The top 16 of the staple is sufficiently wide so the staple easily spans the width of the heating element as shown in FIG. 3. This is important because during a heating cycle, the heating element expands.

In addition to the foregoing, other features available through use of glass staples 10 are that the staples can be used in an automated manufacturing process so they can be automatically inserted in place during assembly of the heating unit. Also, while the staples are normally made of a transparent glass material, the user can, if so desired, have the staples made of a tinted glass material. Either way, the staples provide an improved cosmetic appearance particularly when the heating element is at temperature because dark spots normally created by metal staples of a heavy cross section are eliminated.

What has been described is a glass staple used with a ribbon heating element to mount the heating element in place without damaging a cake of insulation material on which the element is installed, and which allows the heating element to expand and contract during a heating cycle. The glass staples increase the efficiency of the heating element by eliminating hot spots at those locations where the staples are used. Further, the staples do not appear as dark spots to one viewing the heating element so the heating element has a uniform appearance. The staple is a high temperature, transparent, electrically insulating glass material which may be tinted if so desired by the user. The staples have sufficient mechanical strength to withstand numerous heating cycles of the heating element without cracking or breaking, and the staples, which can be readily installed by an automated manufacturing process provide a low cost, effective solution to conventional wire staples.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. In a heating unit comprising a thin and relatively fragile resistive heating element for generating heat when an electrical current is supplied thereto, and an insulation material having a surface upon which said heating element is placed, said heating element being arranged in a predetermined pattern upon said surface, the improvement comprising a non-metallic staple securing said heating element upon said surface, said non-metallic staple reducing the heat sink created at the location where the staple is used so to effect a more efficient heat transfer being the heating element and that which is being heated by the heating element.

2. The improvement of claim 1 wherein said staple is formed of a glass.

3. The improvement of claim 1 including a plurality of glass staples spaced along the length of said heating element to attach said heating element to said insulation material.

4. The improvement of claim 2 wherein said glass is a transparent glass.

5. The improvement of claim 2 wherein said glass is an electrically insulative glass so to prevent a short circuit if two staples inadvertently are in contract with each other.

6. The improvement of claim 2 wherein said staple is generally U-shaped with one leg of the staple being longer than the other.

7. The improvement of claim 4 wherein said glass is a tinted glass, the glass being tinted to a color which aesthetically enhances the appearance of said heating unit.

8. A heating unit comprising:

a ribbon-type heating element for generating heat when an electrical current is supplied thereto;

an insulation material having a surface upon which said heating element is placed, said heating element being arranged in a predetermined pattern upon said surface; and, a non-metallic staple securing said heating element upon said surface, said non-metallic staple reducing a heat sink effect created at the location where the staple is used so to effect a more efficient heat transfer being the heating element and that which is being heated by the heating element.

9. The heating unit of claim 8 wherein said staple is formed of a glass.

10. The heating unit of claim 9 including a plurality of glass staples spaced along the length of said heating element to attach said heating element to said insulation material.

11. The heating unit of claim 9 wherein said glass is a transparent glass.

12. The heating unit of claim 11 wherein said glass is an electrically insulative glass so to prevent a short circuit if two staples inadvertently are in contract with each other.

13. The heating unit of claim 9 wherein said staple is generally U-shaped with one leg of the staple being longer than the other.

14. The heating unit of claim 11 wherein said glass is a tinted glass, the glass being tinted to a color which aesthetically enhances the appearance of said heating unit.

* * * * *